US007025023B2

(12) United States Patent
Lehmann et al.

(10) Patent No.: US 7,025,023 B2
(45) Date of Patent: Apr. 11, 2006

(54) HYDRAULIC CAMSHAFT ADJUSTER FOR AN INTERNAL COMBUSTION ENGINE

(75) Inventors: Kai Lehmann, Ludwigsfelde (DE); Jens-Uwe Plank, Berlin (DE); Jörg Rösener, Berlin (DE); Holger Rudzinski, Berlin (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/959,541

(22) Filed: Oct. 6, 2004

(65) Prior Publication Data

US 2005/0066924 A1 Mar. 31, 2005

(30) Foreign Application Priority Data

Oct. 7, 2003 (DE) ..... 103 46 443

(51) Int. Cl.
*F01L 1/34* (2006.01)

(52) U.S. Cl. ..... 123/90.17; 123/90.12; 123/90.15; 123/90.16; 123/90.31; 74/568 R; 464/1; 464/2; 464/160

(58) Field of Classification Search ..... 123/90.17; 74/568 R

See application file for complete search history.

(56) References Cited

U.S. PATENT DOCUMENTS

| | | | | |
|---|---|---|---|---|
| 5,088,456 | A * | 2/1992 | Suga | 123/90.17 |
| 5,450,825 | A * | 9/1995 | Geyer et al. | 123/90.17 |
| 6,311,658 | B1 * | 11/2001 | Eguchi | 123/90.17 |
| 6,363,896 | B1 * | 4/2002 | Speier | 123/90.17 |

FOREIGN PATENT DOCUMENTS

| | | |
|---|---|---|
| DE | 42 37 193 | 5/1994 |
| DE | 197 47 244 | 4/1999 |
| DE | 198 17 319 | 10/1999 |

* cited by examiner

*Primary Examiner*—Thomas Denion
*Assistant Examiner*—Kyle M. Riddle
(74) *Attorney, Agent, or Firm*—Klaus J. Bach

(57) ABSTRACT

In a hydraulic camshaft adjuster for an internal combustion engine including a hydraulic operating unit for adjusting the angular position of the camshaft relative to a camshaft drive by way of a hydraulic control valve with a valve housing in which a control piston is disposed for controlling the supply of hydraulic fluid to, and its removal from, the hydraulic operating unit and to which hydraulic fluid is supplied from the camshaft by way of a pressure channel which is formed into the valve housing so as to extend along the outer surface thereof and a sleeve tightly surrounds at least the part of the valve housing which includes the channel for tightly covering the channel.

10 Claims, 2 Drawing Sheets

HYDRAULIC CAMSHAFT ADJUSTER FOR AN INTERNAL COMBUSTION ENGINE

BACKGROUND OF THE INVENTION

The invention relates to a hydraulic camshaft adjuster for an internal combustion engine with a camshaft including a control valve having a control piston axially movably disposed in a valve housing for controlling the admission of hydraulic fluid to, and the release thereof from, a device for adjusting the angular position of the camshaft relative to the crankshaft of the engine.

For lowering the fuel consumption and the raw emissions of an engine and for increasing the engine power and engine torque gasoline engines are often provided with camshaft adjusters. The camshaft adjusters adjust the angular position of the camshaft relative to the crankshaft of the engine. Today, mostly hydraulic blade controllers with hydraulic operating chambers are used. The angular adjustment is performed by the controlled supply of oil from the engine oil circuit to the operating chambers of the blade controllers. The oil supply and the release of the oil is controlled by a control valve which is electromagnetically operated.

DE 198 17 319 A1 discloses a hydraulic camshaft adjuster for an internal combustion engine which includes a control valve with pressure medium flow control passages. By means of the control valve, an adjuster unit for the angular position adjustment of a camshaft can be controlled wherein the adjuster unit includes an inner body which is mounted to the camshaft for rotation therewith and an outer body which is rotatable relative to the camshaft and which is operatively connected to the crankshaft of the engine so as to be driven thereby. The control valve includes a control piston which is axially movably supported in a cylindrical cavity of a central clamping bolt by which the inner body is mounted axially to the camshaft. Pressurized fluid flow passages are provided in the camshaft and in the inner body of the camshaft adjuster which are difficult to machine into the camshaft and the control valve body so that the arrangement is difficult and expensive to manufacture.

It is the object of the present invention to provide a hydraulic camshaft adjuster with hydraulic fluid passages which are relatively easy to manufacture and wherein the arrangement at the same time is relatively small and lightweight.

SUMMARY OF THE INVENTION

In a hydraulic camshaft adjuster for an internal combustion engine including a hydraulic operating unit for adjusting the angular position of the camshaft relative to a camshaft drive by way of a hydraulic control valve with a valve housing in which a control piston is disposed for controlling the supply of hydraulic fluid to, and its removal from, the hydraulic operating unit and to which hydraulic fluid is supplied from the camshaft by way of a pressure channel, the pressure channel is formed into the valve housing so as to extend along the outer surface thereof and a sleeve tightly surrounds at least the part of the valve housing which includes the channel for tightly covering the channel.

An important advantage of the camshaft adjuster according to the invention resides in the fact that its hydraulic fluid supply system is relatively simple to manufacture.

During the manufacture of the valve housing for the control valve passages are machined into the valve sleeve which extends axially from the camshaft end or, respectively, the threaded end of the clamping bolt up to an oil transfer location to the operating chambers of the camshaft adjuster, the passages being open axial supply grooves cut into the clamping bolt. This can be done already during the manufacture of the unfinished product by an inexpensive forming process. The open pressurized fluid passages are closed by a sleeve extending over the valve housing and covering the open passages. The sleeve extends from the camshaft end or, respectively the threaded end of the clamping bolt at least to the end of the open pressurized fluid passages or over the full length of the valve housing. It is advantageous that therefore no axial bores have to be drilled into the valve housing walls. The drilling of axial bores would result in increased manufacturing expenses. Specifically, it would be necessary to remove any burrs at the intersections of axial and radial bores. In addition, the axial bores could have only very small cross-sections since the walls of the valve housing are relatively thin.

In the area of the fluid transfer from the control valve to the operating chambers of the camshaft adjuster, the sleeve includes openings so that the bores in the valve housing are not covered. Preferably, the openings are larger than the cross-sections of the bores in the valve housing in order to accommodate tolerances.

Preferably, at the outer surfaces of the sleeve there are sealing means which accommodate tolerances and heat transfer differences and which reduce any leakage between the various pressure fluid spaces, as the sealing means seal against the inner body of the camshaft adjuster. These sealing means disposed on the outer surface of the sleeve can be so large that they form with the sleeve and the inner body, an annular space so that it is not necessary to provide the grooves in the inner body which are normally present to provide for the transfer of the pressure fluid from the control valve to the operating chambers of the camshaft adjuster.

Further embodiments and advantages of the invention will be described below on the basis of the accompanying drawings.

BRIEF DESCRIPTION OF THE DRAWINGS

For simplicity reasons, identical components are indicated in the drawings by the same reference numerals.

DESCRIPTION OF THE PREFERRED EMBODIMENTS

Figure 1:
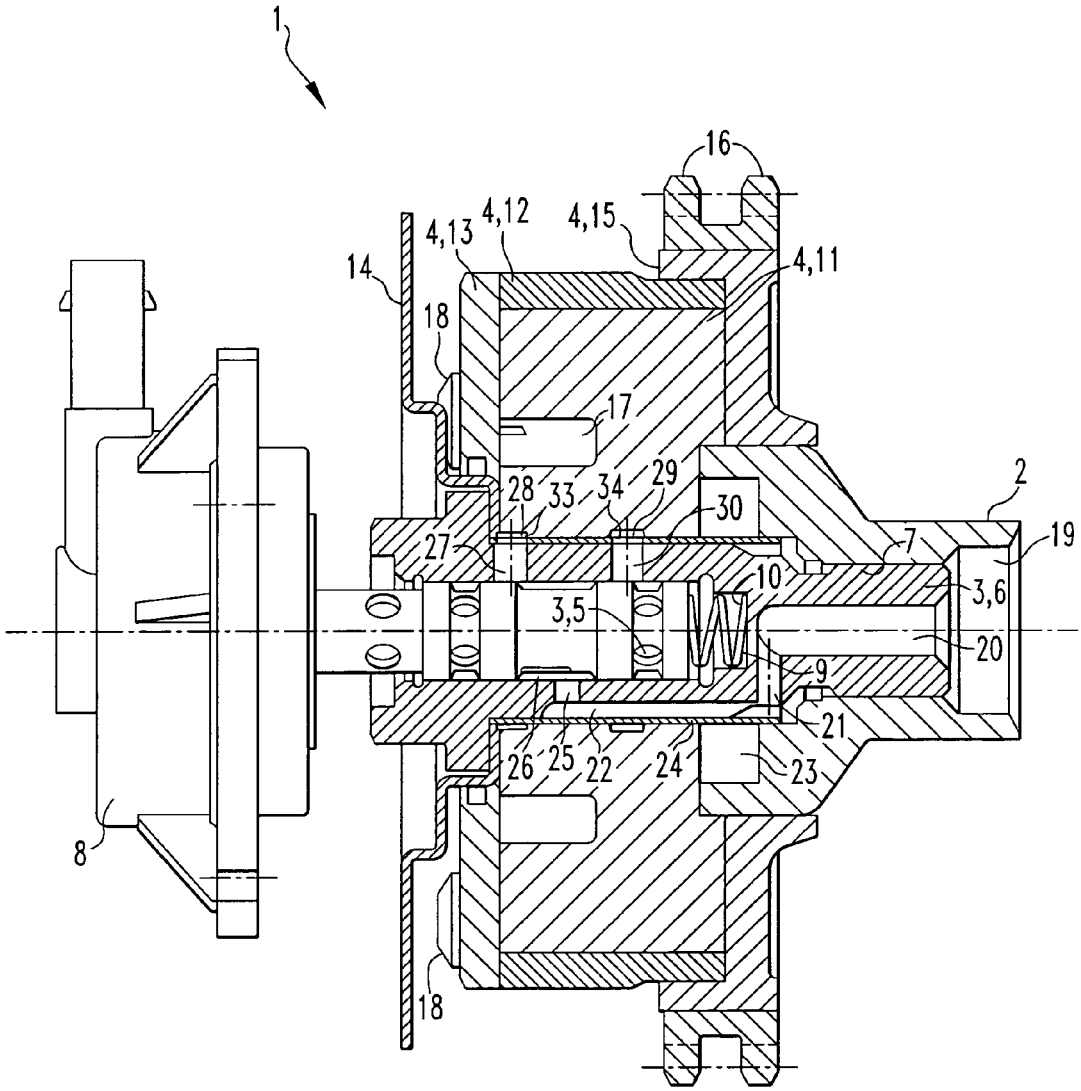
FIG. 1 is an axial cross-sectional view of a first embodiment of a camshaft adjuster with a hydraulic control valve to which pressurized fluid is supplied from a camshaft wherein the control valve includes a control piston which is disposed in a valve housing including a radially open pressurized fluid bore, that is, closed by a sleeve surrounding the valve housing.
Figure 2:
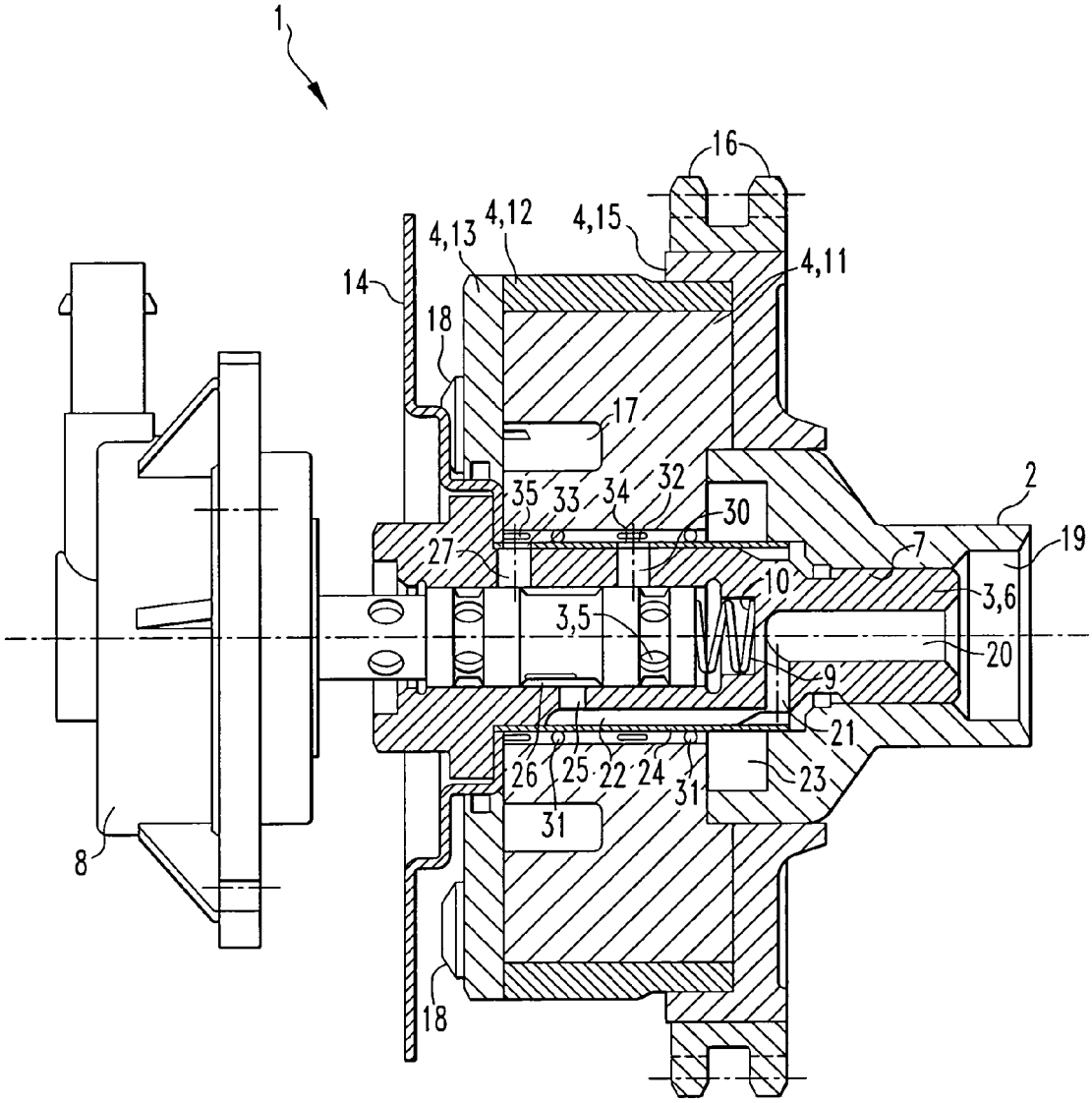
FIG. 2 is an axial cross-sectional view of a second embodiment of a camshaft adjuster wherein the additional sealing means are disposed on the sleeve that is around the sleeve between the sleeve and an inner body of a camshaft adjuster.

The camshaft adjuster as shown in FIGS. 1 and 2 is indicated generally by the numeral 1 and is shown mounted on a camshaft 2 of an internal combustion engine. The camshaft adjuster comprises a hydraulic control valve 3 and an operating unit 4 for adjusting the angular position of the camshaft 2 relative to a crankshaft of an engine.

The hydraulic control valve 3 includes a control piston 5 disposed in a valve housing 6. The valve housing 6 is firmly mounted in an axial opening 7 formed into one end of the camshaft 2 for example by welding or bolting.

At the end of the control piston 5 remote from the camshaft 2, an electromagnetic operating device 8 is mounted on the engine by way of which the control piston 5 is movable against the force of a compression spring 9 disposed in the valve housing supported on the bottom 10 of the valve housing adjacent the camshaft 2. The electromagnetic operating device 8 may be a pressure force generating magnet 8 or a pulling magnet, which is however not shown. Depending on the electromagnetic operating device 8 the compression spring may also be arranged at the opposite end of the pistons 5 remote from the camshaft 2.

The operating unit 4 which is controllable by the electromagnetic operating device 8 via the control piston 5 includes two transmission members which are rotatable relative to each other for the adjustment of the camshaft, that is, an inner member 11 and an outer member 12. At the side of the transmission members 11, 12 adjacent the electromagnetic operating device 8 a disc-like cover 13 with a central opening for receiving the valve housing 6 and a mounting flange disposed between the valve housing 6 and the cover 13 for supporting an impulse wheel 14 are arranged. At the side of the transmission members 11, 12 remote from the electromagnetic operating device 8, a drive wheel 15 is arranged which includes a central opening for accommodating the camshaft 2.

The cover 13 and the drive wheel 15 define therebetween an annular space in which the inner transmission member 11 which is a vane wheel with circumferentially spaced radial vanes is disposed. The inner transmission member is mounted to the camshaft 12 for rotation therewith. The outer transmission member 12 is rotatably supported on the camshaft 2 and carries a drive wheel 15 firmly connected to the outer transmission member 12. The drive wheel 15 may be integrally formed with the outer transmission member 12 and includes a sprocket structure 16 at its circumference by way of which the camshaft 2 is driven from the crankshaft of the engine via a chain. The sprocket structure 16 may also be in the form of a separate sprocket ring which is mounted onto the outer transmission member 12. In place of a chain drive for the camshaft as indicated here by the use of a sprocket wheel, other drive means such as a toothed belt or a gear drive may be provided, of course.

The outer transmission member 12 includes circumferentially spaced radial vanes extending inwardly into the spaces between the vanes extending radially the inner transmission member 11 so as to form operating chambers between the radially inwardly and radially outwardly projecting vanes.

Such a drive or force transmission structure is well-known in the art and is shown in detail for example in DE 198 17 319 A1, FIG. 2.

In order to bring the camshaft adjuster 1 into a predetermined position when no hydraulic fluid pressure is present and/or to compensate for the influences of outer friction of the camshaft, a return spring is provided which is not shown. To this end, the inner transmission member 11 of the camshaft adjuster 1 includes an annular recess 17 wherein the return spring is arranged surrounding the control valve 3. The return spring is connected on one hand to the inner transmission member 11 and, on the other hand, to the cover 13 of the camshaft adjuster 1. However, the return spring does not need to be arranged within the camshaft adjuster 1; it may also be arranged at the outside. Generally, the return spring may be connected to the inner transmission member 11 of the camshaft adjuster 1, the hydraulic control valve 3 or the impulse wheel 14 and on the other hand, to the cover 13 or the outer transmission member 12 of the camshaft adjuster 1.

The cover 13, the drive wheel 15 and the outer transmission member 12 are joined together by clamping bolts 18 extending axially through these components so as to form a unit which is rotatably supported on the camshaft 2.

For the transmission of the drive torque of the crankshaft to the camshaft 2, as already mentioned, the inner transmission member 11 of the camshaft adjuster 1 is connected to the camshaft 2 for rotation therewith. The drive torque is transferred by the outer transmission member 12 of the camshaft adjuster 1 by way of the operating chambers which are formed by the inner and outer transmission members 11 and 12 to the inner transmission member 11.

The pressurized fluid is supplied to the respective operating chambers from the camshaft 2 by way of the pressurized fluid supply passages and channels of the control valve 3. By changing the pressurized fluid supply to the operating chambers, the angular positions of the outer transmission member 12 of the camshaft adjuster 1 and the camshaft 2 is adjustable. The control valve 3 controls the pressurized fluid supply to the camshaft 1 by the position of the control piston 5 in the valve housing 6 and, consequently, the phase relation between the inner and the outer transmission members 11 and 12. The position of the control piston 5 is determined by an equilibrium between the force of the compression spring 9 and the opposite magnet force of the electromagnetic operating device 8.

Pressurized fluid is supplied to the control valve 3 from the interior 19 of the at least partially hollow camshaft 2. From the interior 19, the pressurized fluid reaches, by way of an axial channel 20 disposed in the valve housing 6 of the control valve 3, radial bores 21 of the valve housing 6, which lead to a pressurized fluid passage 22, which is also arranged in the valve housing 6, and also an annular space 23 formed in the camshaft 2.

In order to provide a simple inexpensive arrangement for conducting the pressurized fluid, the pressurized fluid channel 22 extending axially through the valve housing 6 is a radially outwardly open groove which is covered by a sleeve 24 which extends around the valve housing 6. The pressure fluid channel 22, which extends essentially in the axial direction of the camshaft 2 may have any cross-section. From the pressurized channel 22, the pressurized fluid reaches, by way of a radial bore 25, a pressurized fluid space 26 in the control valve 3 from where the pressurized fluid is directed to the operating chambers of the camshaft adjuster in a known manner by way of a radial bores 22 in the valve housing 6, openings 33 in the sleeve 24 and annular grooves 28 in the inner operating member 11. The release of the pressurized fluid from the operating chambers also occurs in a known manner by way of annular grooves 29 in the inner operating member, openings 34 in the sleeve 24 and radial bores 30 in the valve housing 6 to the interior space of the control valve 3. Alternatively, instead of the axial channel 20 in the valve housing 6, an axial groove may be provided in the valve housing 6, which provides for communication between the pressure fluid channel 22 and the inner space 19 of the camshaft 2.

In addition, the camshaft adjuster 1 may include a hydraulically operable locking mechanism (not shown) consisting of a bolt and a compression spring which, with an axial movement of the bolt interlocks the inner operating member 11 and the rotatably supported unit comprising the cover 13, the drive wheel 15 and the outer operating member 12. This locking connection is released by applying pressurized fluid to the camshaft adjuster in a certain way.

FIG. 2 shows an arrangement wherein structures 31 are disposed on the outer surface of the sleeve 24. The seals 31 may be so large that, as shown in FIG. 2, they form annular spaces 32, 35 between the sleeve 24 and the inner operating member 11. These annular spaces 32, 35 facilitate the pressurized fluid transfer from the control valve to the operating chambers of the camshaft adjuster 1 and the pressurized fluid release therefrom to the control valve 3. Then the annular groove 28 and 29 in the inner operating member 11 shown in FIG. 1 are not necessary.

What is claimed is:

1. A hydraulic camshaft adjuster (1) for an internal combustion engine having a camshaft (2), a hydraulic operating unit (4) for adjusting the angular position of the camshaft (2) relative to a camshaft drive, said hydraulic operating unit (4) comprising an inner operating member (11) mounted on the camshaft (2) for rotation therewith and an outer operating member (12) rotatably supported on the inner operating member and defining therebetween operating chambers to which hydraulic fluid can be supplied and from which hydraulic fluid can be discharged for adjusting the relative angular positions of the inner and the outer operating members (11, 12), the outer operating member (12) being operatively connected to a crankshaft of the internal combustion engine for driving the camshaft (2), a hydraulic control valve (3) with a valve housing (6) including a control piston (5) for controlling the supply of hydraulic fluid to, and its discharge from, the hydraulic operating unit (4), said valve housing including at least one pressure channel (22) extending along a longitudinal section thereof for supplying hydraulic fluid to the hydraulic operating unit (4) via the hydraulic control valve (3), the pressure channel (22) being in the form of an open groove extending along the outside of the valve housing (6) and a sleeve (24) surrounding at least a part of the valve housing (6) and tightly covering the pressure channel (22), and an electromagnetic operating unit (8) for operating the hydraulic control valve (3).

2. A hydraulic camshaft adjuster according to claim 1, wherein the valve housing (6) includes bores (27, 30) for the transmission of hydraulic fluid to, and from, the hydraulic operating unit (4) and the sleeve (24) is provided with openings (33, 34) arranged adjacent the bores (27, 30).

3. A hydraulic camshaft adjuster according to claim 2, wherein the openings (33, 34) in the sleeve (24) are larger than the bores (27, 30) in the valve housing (6) to accommodate manufacturing tolerances.

4. A hydraulic camshaft adjuster according to claim 1, wherein the control valve is in communication with an inner pressurized fluid supply space (19) of the camshaft (2) by way of a passage (20) extending axially through the valve housing (6).

5. A hydraulic camshaft adjuster according to claim 1, wherein the sleeve (24) is provided at its outer surface with at least one seal structure (31).

6. A hydraulic camshaft adjuster according to claim 5, wherein the at least one seal structure (31) form annular spaces (32, 35) between the sleeve (24) and the inner operating member (11).

7. A hydraulic camshaft adjuster according to claim 1, wherein the sleeve (24) is firmly mounted onto the valve housing (6).

8. A hydraulic camshaft adjuster according to claim 1, wherein the sleeve (6) consists of one of a plastic material and a metal sheet.

9. A hydraulic camshaft adjuster according to claim 5, wherein the seal structures (31) consist of one of a plastic material and a metal sheet.

10. A hydraulic camshaft adjuster according to claim 1, wherein the valve housing (6) of the control valve (3) consists of one of a plastic material, aluminum and steel.

* * * * *